United States Patent [19]

Bland et al.

[11] Patent Number: 4,796,010

[45] Date of Patent: Jan. 3, 1989

[54] INTRUSION ALARM AND AUTOMATIC ILLUMINATION SYSTEM

[76] Inventors: Robert T. Bland, 919 Arbor Ct., Wheaton, Ill. 60187; Al Stigvils, 266 Belden Ave., Glendale Heights, Ill. 60139

[21] Appl. No.: 890,025

[22] Filed: Jul. 28, 1986

[51] Int. Cl.[4] ..... G08B 13/08

[52] U.S. Cl. ..... 340/541; 340/506; 340/528; 340/691; 340/693

[58] Field of Search ..... 340/541, 527, 528, 534, 340/531, 693, 545, 546, 333, 506, 691, 636

[56] References Cited

U.S. PATENT DOCUMENTS

| | | | |
|---|---|---|---|
| 3,510,863 | 5/1970 | McBrian | 340/545 |
| 4,151,520 | 4/1979 | Full | 340/528 |
| 4,155,081 | 5/1979 | Haglund | 340/636 |
| 4,167,680 | 9/1979 | Gross | 340/333 |
| 4,206,450 | 6/1980 | Harden et al. | 340/541 |
| 4,223,232 | 9/1980 | Bulat | 340/333 |
| 4,422,068 | 12/1983 | Helft et al. | 340/541 |
| 4,427,975 | 1/1984 | Kinzie | 340/691 |
| 4,529,970 | 7/1985 | Wyane | 340/506 |
| 4,529,971 | 7/1985 | James | 340/506 |

*Primary Examiner*—Glen R. Swann, III

*Attorney, Agent, or Firm*—Edmond T. Patnaude

[57] ABSTRACT

An intrusion alarm system provides automatic illumination of an entranceway when the entrance door is opened and sounds an audible alarm if the system is not disarmed within a brief predetermined time after the door is opened. The light which is used to illuminate the entranceway is also controlled independently of the alarm system by a conventional wall mounted on/off switch.

9 Claims, 2 Drawing Sheets

INTRUSION ALARM AND AUTOMATIC ILLUMINATION SYSTEM

The present invention relates in general to an intrusion alarm system of the type commonly referred to as a burglar alarm system, and it relates in particular to a new and improved intrusion alarm system which is easily installed in a pre-existing residence, apartment, hotel room or the like and which provides automatic illumination of an entranceway whenever the associated door at the entranceway is opened or the alarm system otherwise detects an intruder.

BACKGROUND OF THE INVENTION

Intrusion alarm systems of the type known in the prior art are usually relatively large, expensive and cumbersome and require considerable time and technical expertise to install in that they require in-the-wall wiring. Consequently, such systems have not been widely accepted for residential use even though the need for intrusion alarm systems is mounting.

There are several desirable features of intrusion alarm systems, and some of these features are found in some prior art systems, but they are not found in all such systems. These features include protection against false alarms caused by transients in the public power supply, courtesy lighting when an entrance door is opened to facilitate entrance to and egress from the premises, battery backup in the event of a power failure, automatic alarm set on power-up after a power failure, and isolation of the alarm circuitry from the public power lines.

An added feature of an intrusion alarm system which would be highly desirable would be the adaptability of the system to pre-existing structures in a fast and simple manner such that a high degree of expertise is not required to install the system whereby the average home or apartment owner could readily install the system himself.

SUMMARY OF THE INVENTION

Briefly, there is provided in accordance with the teachings of the present invention an intrusion alarm systems which is powered from conventional public service power lines and which includes a backup battery and a battery charger, the battery being used only upon failure of the public power service. The system of the present invention is insensitive to transients on the power lines and includes a courtesy light feature which also functions to illuminate the area in which the intrusion occurs so as to enable immediate recognition of the intruder by an occupant of the premises. Also, the system provides automatic alarm set after a power failure.

Another important feature of the system of the present invention is that the existing lights are used in the alarm system.

In accordance with another important feature of the invention the entire control system is adapted to be mounted to a standard switch box and includes a number of manually operable switches corresponding to the original switches and which may be used in exactly the same manner as the original switches were used prior to installation of the intrusion alarm.

BRIEF DESCRIPTION OF THE DRAWINGS

The foregoing and other novel features of the present invention will be better understood by a reading of the following detailed description taken in connection with the accompanying drawing wherein.

DETAILED DESCRIPTION OF A PREFERRED EMBODIMENT

Figure 1:
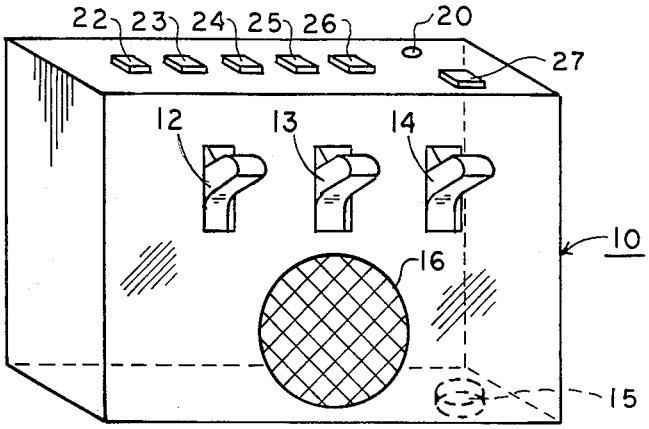
FIG. 1 is a perspective view of the control box portion of an intrusion alarm system embodying the present invention.

Referring to FIG. 1, there is shown a control box 10 which houses the principal controls of an intrusion alarm system embodying the present invention. The control box 10 is adapted to be mounted in place of an existing wall box cover plate with from one to three switches. The box 10 thus includes from one to three conventional manually operable toggle switches 12, 13 and 14 provided on the front face of the box in essentially the same positions as the switches would be located on a conventional switch plate. The box 10 further includes an attractively covered opening 16 behind which is mounted a loudspeaker which is activated when the alarm system is set off. On the top of the box 10 is an indicator light 20 which indicates when the alarm system has been armed or set to operate.

Located at the bottom of the box 10 is a jack 15 to which will be connected by a thin insulated cable 32 to a remote switch box 17 which may be located in a bedroom and which includes a LED alarm indicator 18, a remote light switch 19 and a panic push button switch which is more fully described hereinafter. Removal of the plug from the jack 15 by an intruder will act in the same manner as operation of the panic push button to cause the alarm to sound instantly.

Across the top of the box 10 is a plurality of spring-loaded push button switches 22, 23, 24, 25, 26 and 27. As is more fully described hereinafter these switches are used to arm or disarm the system.

Figure 2:
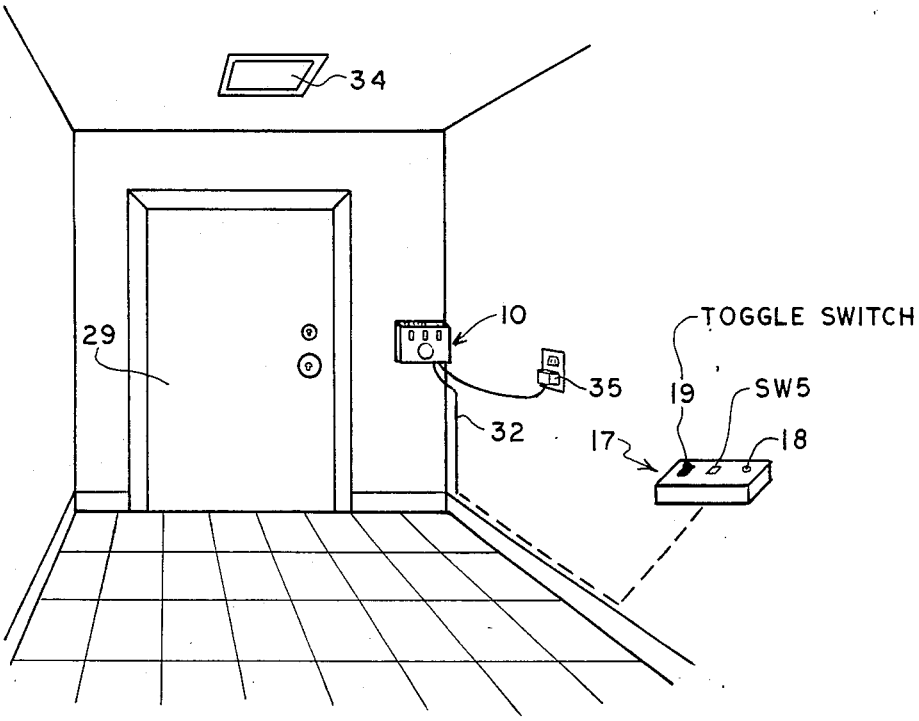
FIG. 2 is a pictorial view of an entranceway at which the alarm system the present invention is installed.

As shown in FIG. 2, the control box 10 is mounted on a wall in proximity to an entranceway which includes a door 29. A very thin insulated wire is connected between the box 10 and a suitable door actuated switch, not shown in FIG. 2, which is normally open, but which is closed when the door 29 is opened. Because of the fact that the wire is extremely thin and may be of any desired color, it can be positioned in the corners and along the baseboards of the room or apartment to be practically invisible and not be visually offensive if visible at all. Up to three toggle switches may be provided and they are connected in circuit with whatever lights or other devices were controlled by the replaced switches. The control box 10 may also have adapter plates for use with less than three switches. The other of these switches, switch 12, is connected in the alarm circuit which includes an electric light source 34, which when energized illuminates the entranceway. When the switch 12 is manually moved to the closed position, the light 34 is turned on and the entranceway is illuminated as it originally was before installation of the alarm system. In addition, however, whenever the door 29 is opened the light 34 is also turned on irrespective of the position of the switch 12 and remains illuminated for a short period of time, which in a preferred embodiment of the present invention is two minutes to provide a courtesy light. If, however, the intrusion alarm system has been armed by a proper actuation of alarm set push button 27, which constitutes a manual arming switch, the light 34 will turn on and remain on indefinitely, and the audio alarm will be activated in 20 seconds from the time that the door is initially opened and will sound on for ten minutes unless the proper ones of the decode push button switches 22–26 are actuated in the proper order to disarm the system before the audio alarm is sounded. Of course, only the owner or occupants of the premises will know the proper sequence for actuating the decode push button switches 22–26, and as a result, an intruder opening the door 29 will set off the alarm. It will be understood as this description proceeds that other electric lights can also be turned on and other alarm devices can be energized under control of the alarm circuitry located within the box. For example, an automatic telephone dialing system for alerting the police to the intrusion can be activated if the intruder does not properly operate the decode push button switches 22–26 within the allowed 20 second time period.

Figure 3:
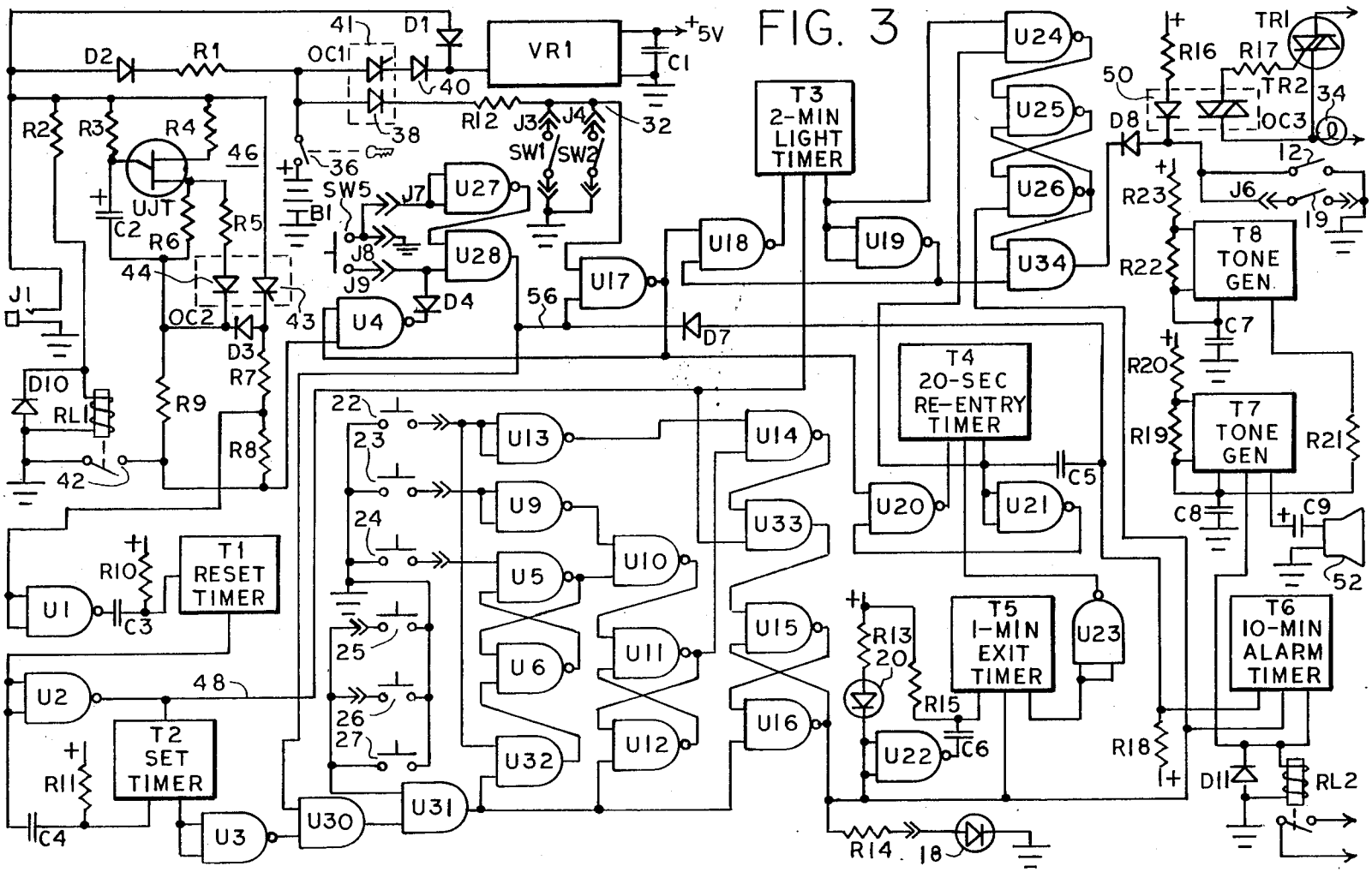
FIG. 3 is a schematic circuit diagram of an intrusion alarm system embodying the present invention.

Refer now to FIG. 3 wherein is shown a schematic circuit diagram of the electronic controls for an intrusion alarm system embodying the present invention. As there shown, an input jack J1 is adapted to be connected to a 120 volt AC public service power line through a conventional voltage reduction DC power supply 35 (FIG. 2). A power outlet is usually provided in proximity to an entrance door to a home or apartment wherefor it is a simple matter to connect the DC power supply 35 between the jack J1 and the power line. Connected directly to the terminal of the jack J1 is a blocking diode D1 which is used to prevent the discharge of a backup battery B1 if AC power is interrupted, and a voltage regulator VR1 which provides a regulated 5 volt DC voltage across a filter capacitor C1 connected between the output of the voltage regulator VR1 and ground.

In the event of a power failure, the control circuit is operated by the battery B1 which is charged from the power line via a diode D2 and a resistor R1 whenever the intrusion alarm system is connected to the power lines. As described hereinafter, whenever an AC power failure occurs, the system automatically operates under battery power and is automatically armed. An on-off key switch 36 which must be turned on before it can be removed from its cylinder is provided to disconnect the battery B1 from the system during long periods of power failure thus allowing the owner to leave the premises without setting off the alarm. If AC power is restored, even though the switch 36 is open, the alarm will automatically be re-armed and the system will operate from the AC power source via the power supply 35. It will be seen that on loss of the external AC power the battery B1 is isolated from the power supply 35 by the diodes D1 and D2 and is effectively out of the circuit so as to retain its charge for a maximum period of time except when the alarm is activated by an intruder by closing at least one of the plurality of alarm operating normally open switches SW1 or SW2. The switches SW1 and SW2 are mounted so as to be closed when the entrance door or aux door or window is opened. When one of these switches SW1 and SW2 is closed during a power failure, current flows from the battery B1 through an LED 38 of an optical coupler OC1 and a resistor R12 to operate the system.

A diode 40 is serially connected between the optical coupler OC1 and the connection between the diode D1 and the voltage regulator VR1 so that the cathode of an SCR 41 in the optical coupler OC1 is more positive than the positive terminal of the battery B1 when AC voltage is present on the AC power lines, wherefor the SCR 41 cannot fire unless there is a power failure. Only if the AC power has been lost will closing of one of the switches SW1 or SW2 energize the optical coupler OC1 to permit the SCR 41 to fire and power the system from the battery Bl. The diodes D1 and D2 prevent discharging of the battery through the external AC power system.

As is more fully described hereinafter, when either of the switches SW1 or SW2 is closed during an AC power failure there is no twenty second time delay, but rather the audio alarm is immediately energized. Otherwise, during normal operation there is a 20 second period following the closing of one of the switches SW1 or SW2 during which the occupant of the premises has time to unarm the system using the decode push buttons 22–26 and thus prevent the audio alarm from sounding.

For normal AC operation a resistor R2 and the solenoid of a relay RLY 1 are connected in series directly across the terminals of the jack J1. A set of normally open contacts 42 on the relay RL1 are connected in series with an SCR diode 43 of an optical coupler OC2 and two resistors R7 and R8. The optical coupler also includes an LED 44 which when fired permits the SCR 43 to fire. It may thus be seen that when the SCR 43 is fired a DC voltage is provided at the junction of the resistors R7 and R8. This DC voltage is used for the automatic arming of the alarm when AC is initially applied or reapplied following a power failure.

In order to permit the circuit components to reach a steady state of operation when power is first applied to the system, there is provided a time delay circuit 46 which includes an RC timing circuit made up of resistors R3 and R9 and a capacitor C2. A unijunction transistor UJT is connected in series with a resistor R6 across the capacitor C2 and permits the capacitor C2 to charge when the circuit is first energized. When the unijunction transistor is fired current flows through a resistor R4 and the resistor R6 by the discharge of the capacitor C2 wherefor a voltage is developed across the resistor R6 which in turn energizes the LED 44 through the resistor R5 to fire the SCR 43. Once the unijunction transistor fires, the diode D3 conducts current through resistor R9 and effectively shorts out the unijunction transistor UJT and effectively shorts out the unijunction transistor timing circuit thus preventing the continuous pulsing of the LED 44. The SCR 43 of the optical coupler OC2 will continue to conduct as long as the power from the power supply 35 to the jack J1 is not interrupted.

When the SCR 43 fired a positive voltage is applied to both inputs of a gate U1. This signal is inverted at the output of U1 and a momentary logic 0 is seen at the input of a reset timer T1 which causes timer T1 to start timing. During the timing of reset timer T1, the output signal goes to a logic 1 for a timer period of perhaps one second. This logic 1 connected to the input of a set timer T2 has no effect on timer T2. However, this same logic 1 connected to both inputs of a gate U2 are inverted to a logic 0 on a line 48 which resets the timer T2 in the event that power up transients may have tried to start timing of the timer T2. This insures that the timer T2 will always time after timer T1 has timed out. With line 48 being at logic 0 during the timing of reset timer T1, the logic 0 on the line 48 resets the decode flip flops made up of gates U15 and U16 which in turn resets an exit timer T5, a 10 minute timer T6, and light latching flip flops made up of gates U25 and U26. Also, the logic 0 on line 48 resets a light timer T3.

At the end of the period timed out by the reset timer T1, its output changes back to a logic 0 and becomes inverted to a logic 1 which appears on line 48 which removes the reset from the set timer T2, the flip flop made up of gates U15 and U16, and the light timer T3. The logic 0 from the output of the reset timer T1 is connected also to a capacitor C4 causing a momentary logic 0 at the input of set timer T2 which causes it to start timing. During timing the output of the set timer T2 is a logic 1 and is inverted by gate U3 to a logic 0 which sets flip flops U5 and U6, U11 and U12, and U15 and U16 causing a complete set of the decoder circuit. As a result the output of U16 now being at a logic 1 which removes the reset to the one minute timer T5, the ten minute alarm timer T6 and the light latch flip flop made up of gates U25 and U26 are thus allowed to operate when their respective inputs receive the proper logic 0 signals. It can now be seen that the logic 1 from the output of gate U16 is also inverted to a logic 0 by gate U22 thus placing a momentary logic 0 through capacitor C6 at the input of the exit timer T5 causing it to start timing. During the timing of the one minute exit timer T5 its output is at a logic 1 and is inverted to a logic 0 by gate U23 and is connected to the reset input of the 20 second re-entry timer T4 thus preventing the operation of timer T4 for one minute. Since the re-entry timer T4 is inhibited for a one minute time period, the operation of the switches SW1 or Sw2 will not cause the re-entry timer T4 from timing for up to a one minute timer interval. This gives the same action as would a person setting the alarm one minute before leaving the premises and thereby opening the one of the switches SW1 or SW2 which is connected to the door. After the one minute interval has expired, closing either of the switches SW1 or SW2 will set off the alarm.

The remote LED 18 is connected in series with a LED 20 and a pair of resistors R13 and R14 between the power supply and ground to show when the system is in operation. LED 20 is located on the alarm box while LED 18 is in a remote location such as in the bedroom. Both LEDS 18 and 20 are never on or off at the same time as will be seen by the following circuit description. The output of the gate U16 acts as a switch to these LEDS. When the alarm is set, the output of the gate U16 is at a logic 1 which turns on the remote LED 18 located remotely in a dark bedroom clearly indicating to the resident that the alarm is set. At the same time this logic 1 prevents current from flowing through LED 20 located on the alarm box, causing it to go out. This indicator, the lighted LED 20, warns the resident that may be exiting the premises that the alarm has not been set. It is intended that an intruder looking into this area should not be attracted to the box when it is armed. Therefore, the resident must press the alarm set push button 27 to set the alarm causing LED 20 to extinguish. After setting the alarm, the one minute exit timer T5 starts timing.

When the door 29 is opened during the one minute exit time so that one of the switches SW1 or SW2 is closed, a courtesy light timer T3 is turned on and produces a logic 1 output which is inverted through a gate U19 placing a logic 0 at diode D8 causing a current to flow through a resistor R16, a LED 50 and a diode D8 which in turn fires a triac TR2 which is connected in the trigger circuit of triac TR1 through a resistor R17 causing the triac TR1 to fire. As a result, the light 34 is turned on for the two minute time period of the light timer T3. It will also be noted that the light switch 12 is also connected to diode D8 in such a way that when the light switch 12, which is the wall light switch on the box is closed, the resulting ground to the diode D8 is blocked from appearing at the output of the gate U34 but caused current again to flow through resistor R16 and LED 50 which allows the light 34 to be manually turned on. The other switch 19 is located on the box 17 at a remote location such as the bedroom so that in the event of a strange noise or the like from the remote location allows the resident to turn on light 34 so that he may look out of a dark room into a lit room to visually look to see if an intrusion occurred.

After the one minute exit timer T5 has timed out, closing of one of the switches SW1 or SW2 places a logic 0 to one of the inputs of gate U17 while the other input is at logic 1 from the output of gate U4 (inverted logic 0 as a result of ground logic 0 through RLY 1 contact), causing the output of gate U17, a logic 1, to appear at the inputs of gates U18 and U20. Both of these gates simultaneously start their timers T3 and T4 timing. The outputs of both timers T3 and T4 go to a logic 1 during timing and their outputs are inverted by gates U19 and U21 and fed back as logic 0's to their respective inputs thus acting as a latch so that any further opening or closing of the switches SW1 or SW2 has no effect on the timing cycles until the timers have timed out to remove the latching effect. Note that both timer outputs, being at logic 1 during timing, appear at the inputs of gate U24 which being inverted to a logic 0 to gate U25 will cause the flip flop made of gates U25 and U26 to set if the alarm is in the armed state. If the alarm is not decoded off during the 20 second timing period, the output of the timer T4 will return to logic 0 and being coupled through capacitor C5 to the input of the 10 minute alarm timer T6, it starts timing. During the timing of timer T6 its output goes to a logic 1, and will operate a relay RL2 whose contacts may be connected to an automatic dialer to dial the police. At the same time this logic 1 removes the reset inhibit signal from a pair of tone generators T7 and T8 allowing a two tone signal to appear at the speaker 52. Although the alarm sound will stop after 10 minutes, the light circuit being in a latched state, will remain on indefinately until decoded off by the resident. This feature is useable to warn a returning resident who seeing the light on, knows there has been an intrusion while he was away, or that possibly the intruder may still be inside and he should be cautious on re-entry.

It should also be noted that if the door is left open at any time it will cause a logic 1 at the output of U17 which is connected to U18 and U20. As stated previously, during the timing of timers T3 and T4 the inverted logic 1 outputs appear as logic 0 to the other gates of U18 and U20. Take timer T3 for example, when it times out, its output switches to a logic 0 which is inverted to a logic 1 at the output of U19 and is fed to the other input of gate U18. As soon as both inputs to U18 are at logic 1, its inverted logic 0 starts to time T3 again. This action continues until the door is closed, thus keeping the light on which also alerts the home owner that the door or auxiliary device is not properly secured.

When the owner of the premises opens the door while the alarm system is in a set or armed condition, he has 20 seconds to reset the system before the re-entry timer T4 times out and sets the alarm timer T6 into operation. In order to reset the system, it is necessary to operate the decode push buttons 22, 23 and 24 in the proper sequence and not to operate any of the push buttons 25 or 26. It may be seen that the decode push button switches 22–23 and 24 are connected to the nand gates U5, U9 and U13 by jacks so that the connections between these switches and these nand gates can be interchanged to set a code for the alarm system. Push buttons 25 and 26 are intermixed to make decoding more difficult since pressing either of these sets any of the previously reset flip flops thus requiring a complete restart of the code sequence.

In order to reset the alarm it is necessary that the flip flop consisting of the nand gates U5 and U6 be first reset whereby the output from the nand gate U5 goes to a logic 1. This is accomplished by first closing the push button 24. Then when the push button 23 is closed thereafter, this logic 0 is inverted to a logic 1 at the input of gate U10 along with the previous logic 1 from output of gate U5 causing an inverted logic 0 to reset U11 and as a result a logic 1 is placed to gate input of U14. Now when push button 22 is closed, this logic 0 is inverted by gate U13 to cause a logic 1 to appear at input of gate U14 along with the previous logic 1 from the output of gate U11 causing U15 to reset. Since the controlling signal is at U16, a logic 0 is used to reset timers T5, T6 and the light switch latch flip flops made up of U25 and U26 and the alarm is now reset.

In addition to the switches SW1 and SW2 which when closed set the alarm off, there is provided push button SW5 which functions as a panic button and which may be located at a remote location such, for example, as in the bedroom of the owner. When the push button SW5 is closed, the line 56 is grounded to instantly fire the triac TR2 and in turn the triac TR1 to light the lamp 34. Also, the ten minute alarm timer T6 is energized through a diode D7 to instantly provide the audible alarm signal. When the push button SW5 is closed the courtesy light timer T3 is energized in the same manner as if door SW1 or SW2 opened. Also the panic ground is coupled to and gate U30, to and gate U31 and finally to the input of the nand gate U16 to remove the inhibit from the ten minute alarm timer so that the timer can fire at this time.

Another important feature of the intrusion alarm system of the present invention is that in the event of a power failure which causes the relay RL1 to drop out and when the power is subsequently returned to the jack J1 the system is automatically set without the owner having to again close the alarm set push button 27.

It may be seen that the switches SW1, SW2, and 19 are connected to the control circuit by respective jacks J3, J4, and J6 and the panic switch is connected to the control circuit by jacks J7, J8 and J9. Preferably these jacks are part of the multiple jack 15. If the multiple jack is pulled off, as for example, by an intruder, ground is removed from the inputs to the gates U27 and U28 producing a logic 0 on line 56 which bypasses the reentry timer T4 and causes the alarm to immediately sound and the light 34 to light whether or not either of the switches SW1 or SW2 is closed.

While the present invention has been described in connection with those particular embodiments thereof, it will be understood by those in the art that many changes may be made without departing from the true spirit and scope of the present invention. Therefore, it is intended by the appended claims to cover all such changes and modifications which come within the true spirit and scope of this invention.

What is claimed:

1. An intrusion alarm system for detecting intrusion of an area via an entranceway comprising in combination control circuit means adapted to be powered from a source of D.C. voltage, first switch means located remotely from said control circuit means, coupling means connecting said source of D.C. voltage and said first switch means to said control circuit means, electric light means for illuminating said entranceway, second switch means for energizing said electric light means independently of said first switch means, alarm means included in said control circuit for energizing said electric light means and for emitting an audible alarm in response to the actuation of said first switch means, a battery included in said control circuit means, means for charging said battery from said source of D.C. voltage, manual switch means for arming and disarming said alarm means to emit said audible alarm, and means responsive to a loss of D.C. voltage from said source while said source is coupled to said control circuit means for powering said control circuit means from said battery and for arming said alarm means when said alarm means was disarmed by said manual switch means.

2. An intrusion alarm system according to claim 1, further comprising means responsive to a reoccurrence of said D.C. voltage following a lapse thereof for powering said control circuit means from said source and for enabling said alarm actuator means to actuate said alarm irrespective of the position of said manual arming switch means.

3. An intrusion alarm system according to claim 2, further comprising first time delay means responsive to said reoccurrence of said D.C. voltage for disabling said alarm actuator for a predetermined period of time following said reoccurrence of said D.C. voltage.

4. An intrustion alarm system for detecting intrusion of an area via an entrance door, comprising in combination an electric light for illuminating said entrance door, control circuit means, detector switch means responsive to the opening of said door and located remotely from said control circuit means and electrically connected thereto, said control circuit means being responsive to the opening of said door and the actuation of said detector switch means to energize said electric light and to emit an audible alarm when said door is opened, first manual switch means for energizing said electric light independently of said detector switch means, and second manual switch means in said control circuit means for disarming said control circuit means to prevent the emission of said audible alarm when said door is opened.

5. An intrusion alarm system according to claim 4 further comprising time delay means for maintaining said electric light energized for a first predetermined time after said detector switch means is initially actuated.

6. An intrusion alarm system according to claim 5 further comprising means in said control circuit means responsive to said second manual switch means being in an armed position for maintaining said electric light energized at the end of said first predetermined time.

7. An intrusion alarm system according to claim 4 further comprising third manual switch means located remotely from said door and from said first manual switch means for causing said control circuit means to energize said light source.

8. An intrusion alarm system according to claim 7 further comprising fourth manual switch means located remotely from said door and from said first manual switch means for causing said control circuit to energize said light source and emit said audible alarm.

9. An intrusion alarm system according to claim 4 further comprising a battery included in said control circuit means, means for charging said battery from a source of D.C. voltage, and means responsive to a loss of said D.C. voltage while said source is coupled to said control circuit means for powering said control circuit means from said battery and for arming said control circuit to cause the emission of said audible alarm in response to the actuation of said detector switch means.

* * * * *